United States Patent [19]

Unterreiner

[11] 3,940,860

[45] Mar. 2, 1976

[54] METHOD AND APPARATUS FOR DRYING A HYGROSCOPIC MATERIAL POSSESSING FIBROUS STRUCTURE

[75] Inventor: Josef Unterreiner, Lucerne, Switzerland

[73] Assignee: Pretema A.G., Birmensdorf, Switzerland

[22] Filed: Dec. 13, 1974

[21] Appl. No.: 532,485

[30] Foreign Application Priority Data

Dec. 18, 1973 Switzerland ..... 17862/73

[52] U.S. Cl. ..... 34/46; 34/73

[51] Int. Cl.[2] ..... F26B 21/06

[58] Field of Search ..... 34/45, 46, 48, 50, 73

[56] References Cited

UNITED STATES PATENTS

| | | | |
|---|---|---|---|
| 1,603,103 | 10/1926 | Anderson | 34/46 |
| 1,997,826 | 4/1935 | Krick | 34/46 |
| 2,370,422 | 2/1945 | Reed | 34/46 |
| 3,337,967 | 8/1967 | Smith | 34/46 |

*Primary Examiner*—Carroll B. Dority, Jr.
*Assistant Examiner*—Larry I. Schwartz
*Attorney, Agent, or Firm*—Waters, Schwartz & Nissen

[57] ABSTRACT

A method of, and apparatus for, drying a hygroscopic material possessing a fibrous structure, such as wood and cardboard, which is impinged in a closed drying compartment by a flowing drying medium, which is heated and demoisturized, and wherein after the introduction of the material to be dried into the drying compartment the drying medium is heated to a predetermined temperature and maintained during the entire drying process at such temperature. The drying medium is moved past the material to be dried in order to remove from such material the expelled moisture. From the point in time of reaching the aforementioned predetermined temperature and a fixed value of the moisture content of the drying medium, calculated after the course of a certain time duration, the drying medium is demoisturized for such length of time until its moisture content has dropped to the aforementioned fixed value. And thereafter in alternate sequence there is interrupted the dehumidification or demoisturizing of the drying medium during the entire predetermined time duration from the point in time of the momentary attainment of the mentioned fixed value of the moisture content of the drying medium, and finally after expiration of the mentioned predetermined time duration the drying medium is demoisturized for such length of time until its moisture content has reached the aforementioned fixed value.

2 Claims, 4 Drawing Figures

% °C
70 70
60 60
50 50
40 40
30 30
20 20
10 10
0
B
A
14
15
16
14a
14b
14c
14d
D
E
F
1
2
3
4
5
6
7
8
9
10
11
12 h t
VENTILATOR
TIMER SWITCH
DEHUMIDIFIER
HYGROSTAT (DEAD TIME)
HEATER

METHOD AND APPARATUS FOR DRYING A HYGROSCOPIC MATERIAL POSSESSING FIBROUS STRUCTURE

BACKGROUND OF THE INVENTION

The present invention relates to new and improved method for drying a hygroscopic material having a fibrous structure, such as wood and cardboard, which is impinged in a closed drying compartment by a current or flowing drying medium which is heated and dehydrated, and further pertains to apparatus for the performance of the aforesaid method.

In the case of hygroscopic materials with fibrous structures, such as wood, veneer, cardboard, by way of example, the danger exists during drying that fissures will form and also that there will occur a deformation of the surface due to encasing of the surface regions, i.e. owing to a closing of the pores in the outermost layers there will be prevented the expulsion of the water present internally of the material.

In order to overcome such drawbacks the state-of-the-art devices for drying of materials with fibrous structure must be equipped with correspondingly complicated and expensive apparatuses and controls, resulting in relatively high costs for the procurement and maintenance thereof.

SUMMARY OF THE INVENTION

Hence, it is a primary object of the present invention to avoid the previously mentioned drawbacks.

Another and more specific object of the invention aims at the provision of a new and improved method of, and apparatus for, enabling in a simple and reliable manner a protective drying of materials having fibrous structure.

Now in order to implement these objects and others which will become more readily apparent as the description proceeds, the inventive method aspects of this development are manifested by the features that after introducing the material to be dried into the drying compartment the drying medium is heated to a predetermined temperature and is maintained at this temperature throughout the entire drying operation. Further, the drying medium is moved past the material in order to take-up moisture which is expelled by the material. From the point in time of reaching the aforementioned predetermined temperature and a fixed value of the moisture content of the drying medium, after termination of a predetermined time duration, the drying medium is dehumidified for such length of time until its moisture content has dropped to the aforementioned fixed value, and thereafter in alternate sequence there is interrupted the dehumidification of the drying medium during the aforementioned predetermined time duration from the point in time of the momentary attainment of the aforementioned fixed value of the moisture content of the drying medium. Then following completion of the aforementioned predetermined time duration the drying medium is demoisturized for such length of time until its moisture content has reached the aforementioned fixed value.

Not only is the invention concerned with the aforementioned method aspects but also pertains to apparatus for the performance thereof and such apparatus for carrying out the method is characterized according to the invention through the provision of a closed drying compartment with a heating element for heating the drying medium, a desicattor or dehumidifier element for the periodic demoisturizing of the drying medium, a circulation device for moving the drying medium past the material to be dried, and a control device for controlling the heating element and the dehumidifier element and which possesses a measuring feeler arranged in the path of flow of the drying medium which is to be moved past the material to be dried, a hygrostat for cutting-off the dehumidifier, a thermostat for the switching-in and switching-off of the heating element and a time switch which can be switched-on by the hygrostat and after completion of its running time duration switches on the dehumidifier.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
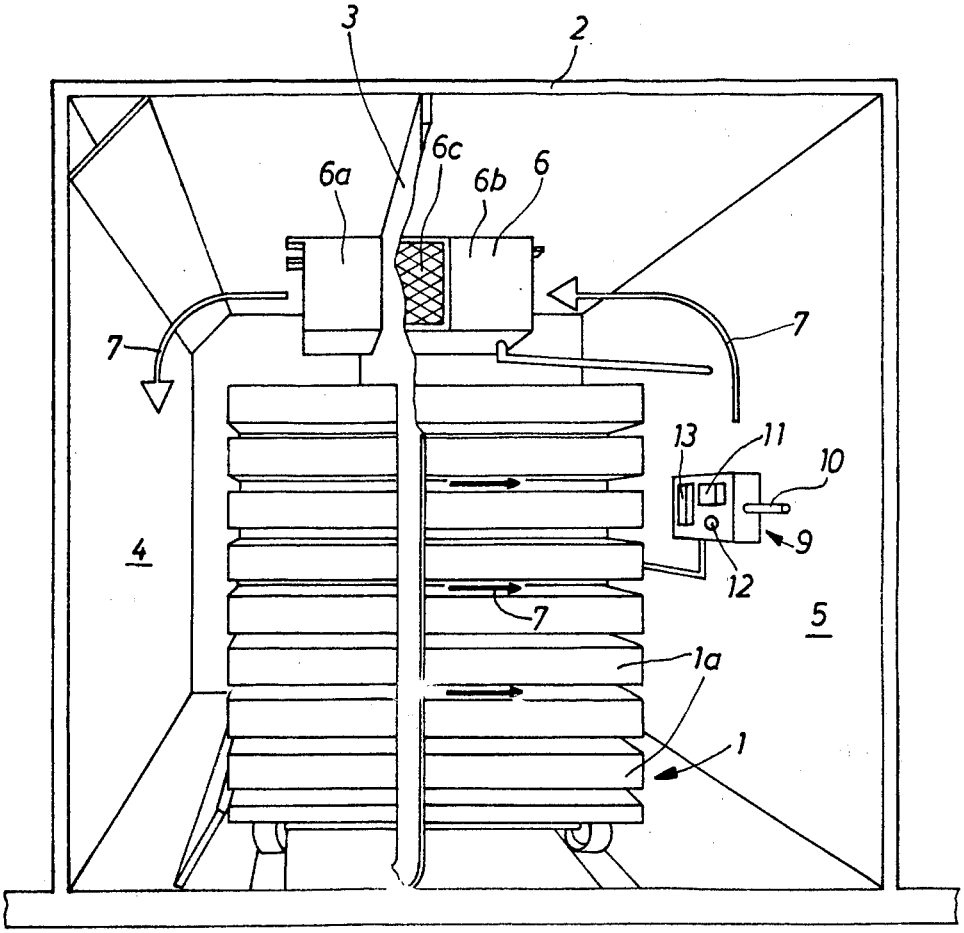
FIG. 1 is a schematic illustration of a first embodiment of a drying compartment.
Figure 2:
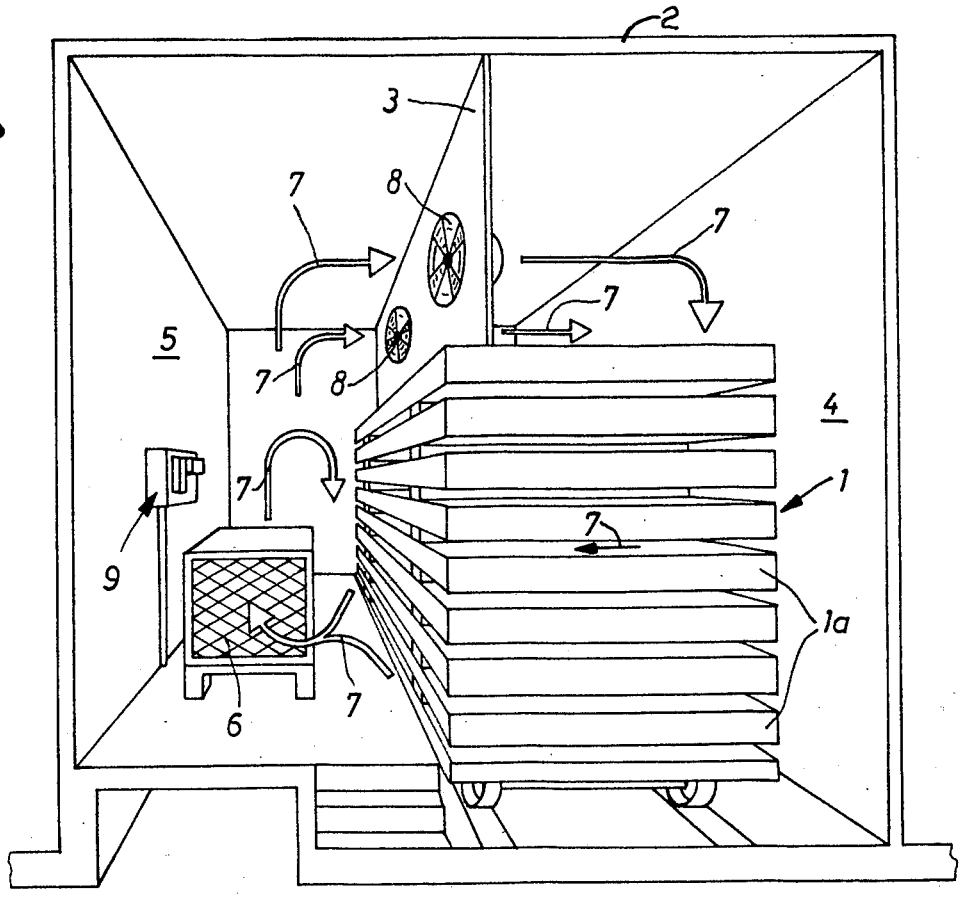
FIG. 2 is a schematic illustration of a second embodiment of a drying compartment.

In FIGS. 1 and 2 there are shown two exemplary embodiments of a drying compartment or chamber for the drying of a material having a fibrous structure. It is to be appreciated that as a matter of convenience in both Figures the same components have been designated with the same reference characters.

The material to be dried, in the present case under consideration, by way of example, a stack 1 of wooden boards 1a arranged in spaced relationship from one another, is disposed in a closed thermally-insulated compartment 2 in such a manner that at both sides of the stack 1 there are provided free zones. The interior of the compartment 2 is subdivided by a partition wall 3 into a pressure compartment 4 and a suction compartment 5, so that a part of the wooden stack 1 is located in the pressure compartment 4 and a part thereof in the suction compartment 5. In the compartment 2 there is arranged an aggregate or assembly 6 which encompasses a dehumidifier or desicattor, a heater and a ventilator, schematically indicated by reference characters **6*a*, 6*b* and 6*c* respectively. By means of this assembly 6 the drying medium, for instance air, is heated in a manner still to be described, demoisturized or dehydrated and circulated. The flow of the drying medium has been conveniently indicated by the arrows 7**.

With the embodiment shown in FIG. 1 the assembly 6 is arranged at the ceiling of the compartment 2 in such a way that its inlet opening is located in the suction compartment 5 and its outlet opening in the pressure compartment 4.

With the embodiment according to FIG. 2 the assembly is arranged in the suction compartment 5, wherein at the partition wall 3 there are installed additional ventilators or fans 8 for the circulation of the drying medium.

Figure 3:
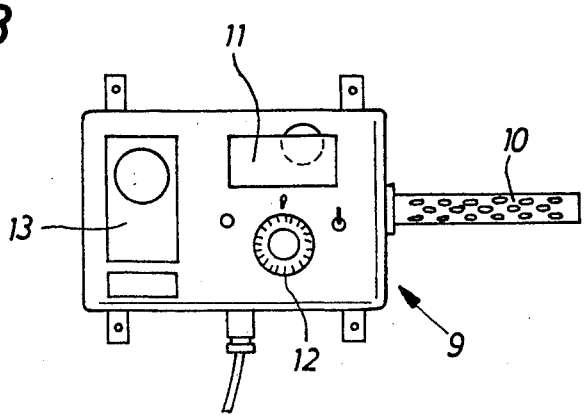
FIG. 3 schematically illustrates the control device installed in the drying compartment.

With both exemplary embodiments there is arranged in the suction compartment 5 a control device or unit 9 for controlling the assembly 6. This control unit 9 has been schematically illustrated in FIG. 3 and possesses a feeler element 10 past which moves the drying medium departing from the wooden stack 1. The control unit 9 furthermore contains a hygrostat 11, a thermostat 12 and a time or timing switch 13. The function of the control device 9 will be clearly apparent from the following description taken in conjunction with FIG. 4.

Figure 4:
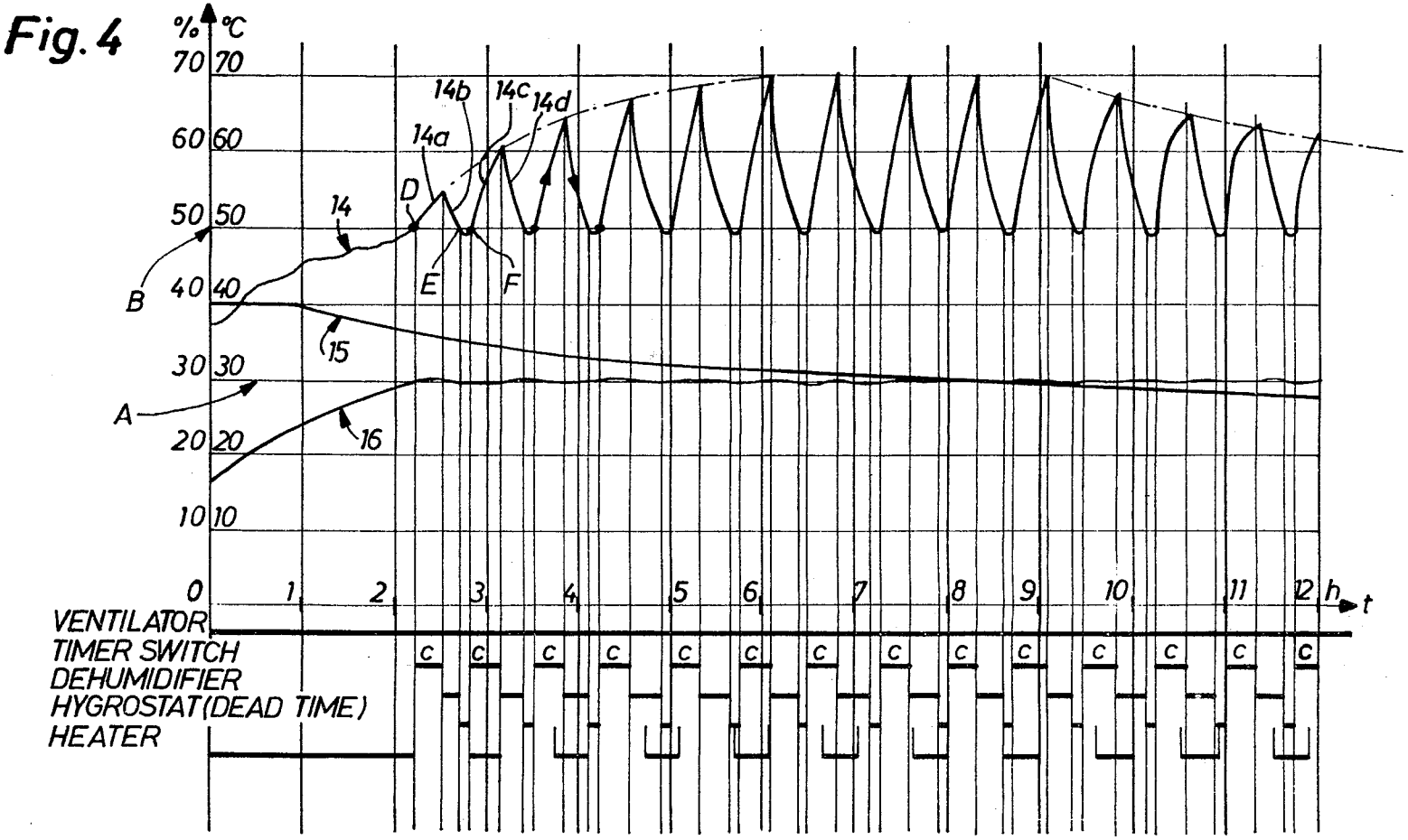
FIG. 4 is a graph for explaining the course of the drying operation.

This FIG. 4 illustrates the graph of the drying process for wooden boards which, as has been shown in FIGS. 1 and 2, are introduced into the drying compartment or chamber 2 in the form of a stack 1. Along the abscissa of the graph there is plotted the time *t* in hours. Along the ordinate there is plotted at the left-hand side thereof the relative moisture in percent and at the right-hand side thereof the temperature in degrees centigrade.

The curve 14 provides the course of the relative moisture of the drying medium during the drying process, whereas the curve 15 indicates the moisture content of the wood. The curve designated by reference character 16 shows the course of the temperature of the drying medium.

Below the abscissa axis there are collectively plotted the time plans for the operation of the ventilator, the time switch, the dehumidifier, the hygrostat or hygrometer and the heater.

It is assumed that moist wooden boards of a certain thickness and a given moisture content of, for instance, 40 percent, are to be dried. At the thermostat 12 there is adjusted a predetermined reference value A for the temperature of the drying medium, for instance 30°C, whereas at the hygrostat or hygrometer 11 there is adjusted a certain reference value B, for instance 50 percent, for the moisture content of the drying medium. These reference values A and B of the temperature and moisture content of the drying medium remain the same during the entire drying operation and are dependent upon the nature of the wood, the thickness of the wooden boards or planks, the moisture of the introduced wet wood, and upon the moisture content of the wood which is desired after the drying operation. At the time switch or timer 13 there is adjusted or set a fixed running time duration C, for instance 20 minutes.

After the introduction of the wooden stack 1 into the closed drying compartment 2 there is turned-on the ventilator 6*c* of the assembly 6, or the ventilators 8 (FIG. 2) respectively. Assuming that the moisture content of the drying medium amounted at the start to 38 percent at 16°C, then gradually the temperature of the drying medium rises according to the curve 16 and the moisture content of the medium according to the curve 14, since the drying medium which moves past the wooden boards takes-up the moisture content delivered by the wooden boards at their surface. During the starting time of the drying process the time switch 13, which turns on the dehumidifier 6*a*, is blocked.

The thermostat 12 shuts-off the heater 6*b* as soon as the temperature of the drying medium has reached the reference value A, that is 30°C. The heating is turned-on and turned-off as required during the entire drying process in order to maintain the temperature of the drying medium at the reference value A.

Now if the moisture content of the drying medium reaches the reference value B set at the hygrostat 11, that is to say 50 percent, then the hygrostat 11 responds. If at the same time the temperature of the drying medium has reached the reference value A (point D, curve 14), then by means of the hygrostat 11 the timer or time switch 13 is turned-on and runs during its running time duration C of, for instance, 20 minutes, as such will be apparent from the corresponding time plan below the axis of the abscissa. During this time duration C the drying medium takes-up the moisture delivered by the wooden boards, so that the relative moisture of the drying medium further increases, as illustrated by the section 14*a* of the curve 14. After expiration of the time duration C of the time switch 13 there is automatically placed into operation the dehumidifier of the assembly 6, so that the drying medium is demoisturized (section 14*b* of the curve 14).

If the moisture content of the drying medium reaches the reference value B (point E of the curve 14), then the hygrostat 11 is again switched-off, with the result that the time switch 13 is reset to null and the dehumidifier is turned off. Owing to the follower action of the dehumidifier the hygrostat 11, after a dead time of about 5 minutes, again turns on (point F, curve 14) whereupon, as already mentioned, the time switch 13 is again switched-on. The moisture content of the drying medium again increases according to the section 14*c* of the curve 14, since the drying medium again takes up the moisture from the wooden boards. After expiration of the running time duration C of the time switch 13 the dehumidifier is again turned-on (section 14*d*, of the curve 14), wherein the drying medium is again demoisturized to the reference value B, whereafter the dehumidifier as already mentioned, is turned-off. The described operation of the alternate demoisturizing of the drying medium and the subsequent interruption of the demoisturizing process, as shown in FIG. 14, is automatically repeated for such length of time until the wooden boards possess the moisture content desired in the dry state. The removal of the moisture from the wooden boards is indicated by the curve 15.

With the described process during the period when the drying medium is not demoisturized, owing to the increasing relative moisture of the drying medium, the delivery of water from the surface zones of the wooden boards is increasingly braked and the movement of the water from the interior of the wooden boards through its surface is enhanced. Consequently, there is prevented an enclosing or encasing of the surface of the wooden boards.

The temperatures of the drying medium required with the described method are lower than with conventional methods and do not exceed 35°C. This condition further contributes to a protective drying of the wet material.

A wetting of the material to be dried during the drying process for the purpose of preventing the aforementioned encasement is not necessary with the described method.

While there is shown and described present preferred embodiments of the invention, it is to be distinctly understood that the invention is not limited thereto, but may be otherwise variously embodied and practiced within the scope of the following claims.

Accordingly, what is claimed is:

1. A method of drying hygroscopic material possessing fibrous structure, such as wood and cardboard, and which is impinged in a closed drying compartment by a flowing drying medium, which is heated and demoisturized, the improvement comprising the steps of: after the introduction of the material to be dried into the drying compartment heating the drying medium to a predetermined temperature, maintaining throughout the entire drying process the drying medium at this predetermined temperature, moving the drying medium past the material to be dried in order to take-up the moisture expelled by such material, and from the point in time when there is reached the aforementioned predetermined temperature and a fixed value of the moisture content of the drying medium, and after expiration of a predetermined time duration, demoisturizing the drying medium for such length of time until its moisture content has dropped to the aforementioned fixed value, thereafter in alternate sequence interrupting the demoisturizing of the drying medium during the entire predetermined time duration from a point in time when there is momentarily attained the aforementioned fixed value of the moisture content of the drying medium, and then after expiration of the aforementioned predetermined time duration demoisturizing the drying medium for such length of time until its moisture content has reached the aforementioned fixed value.

2. An apparatus for drying a hygroscopic material having a fibrous structure, such as wood and cardboard, comprising a closed drying compartment equipped with a heating element for heating a drying medium which impinges the material, a dehumidifier element for the periodic demoisturizing of the drying medium, a circulation device for moving the drying medium past the material to be dried, a control device for controlling the heating element and the dehumidifier, said control device including a measuring feeler arranged in the flow path of the drying medium which is moved past the material to be dried, a hygrostat for switching-off the dehumidifier, a thermostat for switching-in and switching-out the heating element, and a timer switch which can be switched-on by the hygrostat and after expiration of its running time duration switches-on the dehumidifier.

* * * * *